US006398135B1

(12) United States Patent
Hsiao

(10) Patent No.: US 6,398,135 B1
(45) Date of Patent: Jun. 4, 2002

(54) AIR SPRAY DEVICE

(76) Inventor: Chieh-Jen Hsiao, 2F, No. 215, Yu-Te Rd., Pei Dist., Taichung City (TW)

( * ) Notice: Subject to any disclaimer, the term of this patent is extended or adjusted under 35 U.S.C. 154(b) by 0 days.

(21) Appl. No.: 09/791,236

(22) Filed: Feb. 23, 2001

(51) Int. Cl.[7] ..... B05B 9/01; B05B 15/08
(52) U.S. Cl. ..... 239/526; 239/587.1
(58) Field of Search ..... 239/525, 526, 239/587.1

(56) References Cited

U.S. PATENT DOCUMENTS 4,652,024 A * 3/1987 Krohn ..... 15/144.4
6,176,437 B1 * 1/2001 Pedersen ..... 137/624.14
6,213,411 B1 * 4/2001 Jou ..... 239/526

* cited by examiner

*Primary Examiner*—Lesley D. Morris
(74) *Attorney, Agent, or Firm*—Ohlandt, Greeley, Ruggiero & Perle, L.L.P.

(57) ABSTRACT

An air spray device includes a barrel with a passage therein, a valve body disposed in the passage and actuated to move to permit fluid communication between an inlet and an outlet of the passage, spray tube with a first tube portion connected to the outlet, and a second tube portion telescopically fitted in the first tube portion, and a nozzle portion which is disposed outwardly of the second tube portion to generate a compressed air stream for removing dust from an object. Retaining members are disposed in the spray tube for retaining the spray tube in one of stretched and retracted positions. By the telescopic spray tube, the dust to be removed will not fly over the user, and the air spray device is convenient to store.

9 Claims, 7 Drawing Sheets

AIR SPRAY DEVICE

BACKGROUND OF THE INVENTION

1. Field of the Invention

This invention relates to an air spray device, more particularly to an air spray device with a telescopic spray tube that is convenient to use and store.

2. Description of the Related Art

Referring to FIG. 1, a conventional air spray device is shown to include a barrel 1 with a passage 102 which has an inlet 103 and an outlet 104, a valve body 3 which is disposed in the passage 102 between the inlet 103 and the outlet 104 and which has upper and lower O-rings 302 and an annular groove 301, an actuator 5 which is pivotally disposed on the barrel 1 via a pivot pin 4 to actuate the valve body 3 so as to align the annular groove 301 with the inlet 103 and the outlet 104 in order to permit compressed air from the inlet 103 to flow through the outlet 104 and to spray out from a spray tube 6 that is connected to the outlet 104 so as to remove dust on an object for cleaning purposes, and a biasing member 2 which can bias the valve body 3 to align one of the upper and lower O-rings 302 with the inlet 103 and the outlet 104 to interrupt the fluid communication therebetween.

Since the length of the spray tube 6 is fixed, dust to be removed from the object may fly over the user during operation. This is particularly undesirable when the air spray device is applied in conjunction with a painting and coating device. In addition, after use, some painting and coating material may be left in the nozzle portion 61, thereby resulting in inconvenient cleaning thereof. Moreover, numerous air spray devices are required for operating with different materials of painting, thereby resulting in inconvenience during usage.

SUMMARY OF THE INVENTION

The object of the present invention is to provide an air spray device in which a spray tube has a plurality of tube portions telescopically fitted over each other so as to be stretchable and retractable for added convenience during storage and use.

According to this invention, the air spray device comprises a barrel with an inner surrounding wall to define a passage which has an inlet and an outlet downstream of the inlet. A controlling member includes a valve body which is disposed in the passage between the inlet and the outlet, and a stem portion which has an inner end engaging the valve body and an outer end extending from the inner end and transversely and outwardly of the inner surrounding wall so as to be actuated to move the valve body to permit fluid communication between the inlet and the outlet. A biasing member is disposed to bias the valve body to interrupt the fluid communication between the inlet and the outlet. An actuator is disposed on the barrel to actuate the outer end of the stem portion to move the valve body against a biasing action of the biasing member. A spray tube includes first and second tube portions. The first tube portion has a first proximate end which is connected to and which is in fluid communication with the outlet, a first distal end opposite to the first proximate end in a longitudinal direction and downstream of the first proximate end, and a first intermediate tubular portion interposed between the first proximate and distal ends. The first intermediate tubular portion includes a first outer tubular wall surface, and a first inner tubular wall surface which defines a first conduit opposite to the first outer tubular wall surface radially and disposed between and communicating with the first proximate and distal ends. The second tube portion has a second proximate end which is inserted into the first conduit, a second distal end which is disposed opposite to the second proximate end in the longitudinal direction and downstream of the second proximate end and which extends outwardly of the first distal end, and a second intermediate tubular portion which is interposed between the second proximate and distal ends. The second intermediate tubular portion includes a second outer tubular wall surface to be telescopically fitted in the first conduit in the longitudinal direction and to be slidable between a stretched position, where the second proximate end is close to the first distal end, and a retracted position, where the second proximate end is close to the first proximate end, and a second inner tubular wall surface opposite to the second outer tubular wall surface radially and defining a second conduit that is in fluid communication with the first conduit. A nozzle portion is disposed outwardly of the second distal end and distal to the second proximate end, and is fluidly communicated with the second conduit. A first retaining member is disposed on and extends radially and inwardly from the first inner tubular wall surface proximate to the first proximate end so as to arrest further movement of the second proximate end toward the first proximate end in the retracted position. A second retaining member is disposed between the first distal end and the second outer tubular wall surface proximate to the second proximate end to arrest further movement of the second proximate end toward the first distal end in the stretched position.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
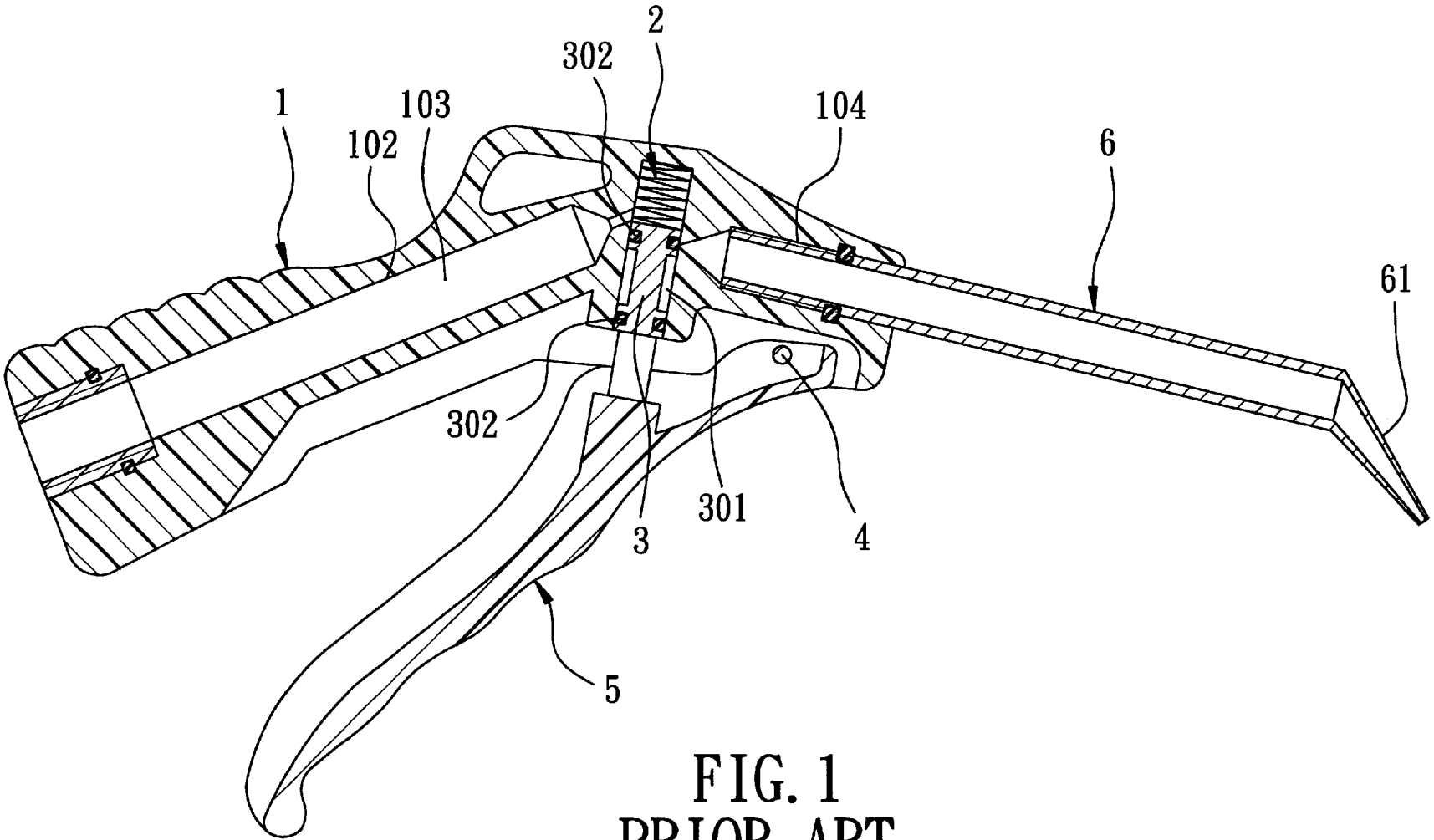
FIG. 1 PRIOR ART
FIG. 1 is a sectional view of a conventional air spray device.

Before the present invention is described in greater detail, it should be noted that same reference numerals have been used to denote like elements throughout the specification.

Figure 2:
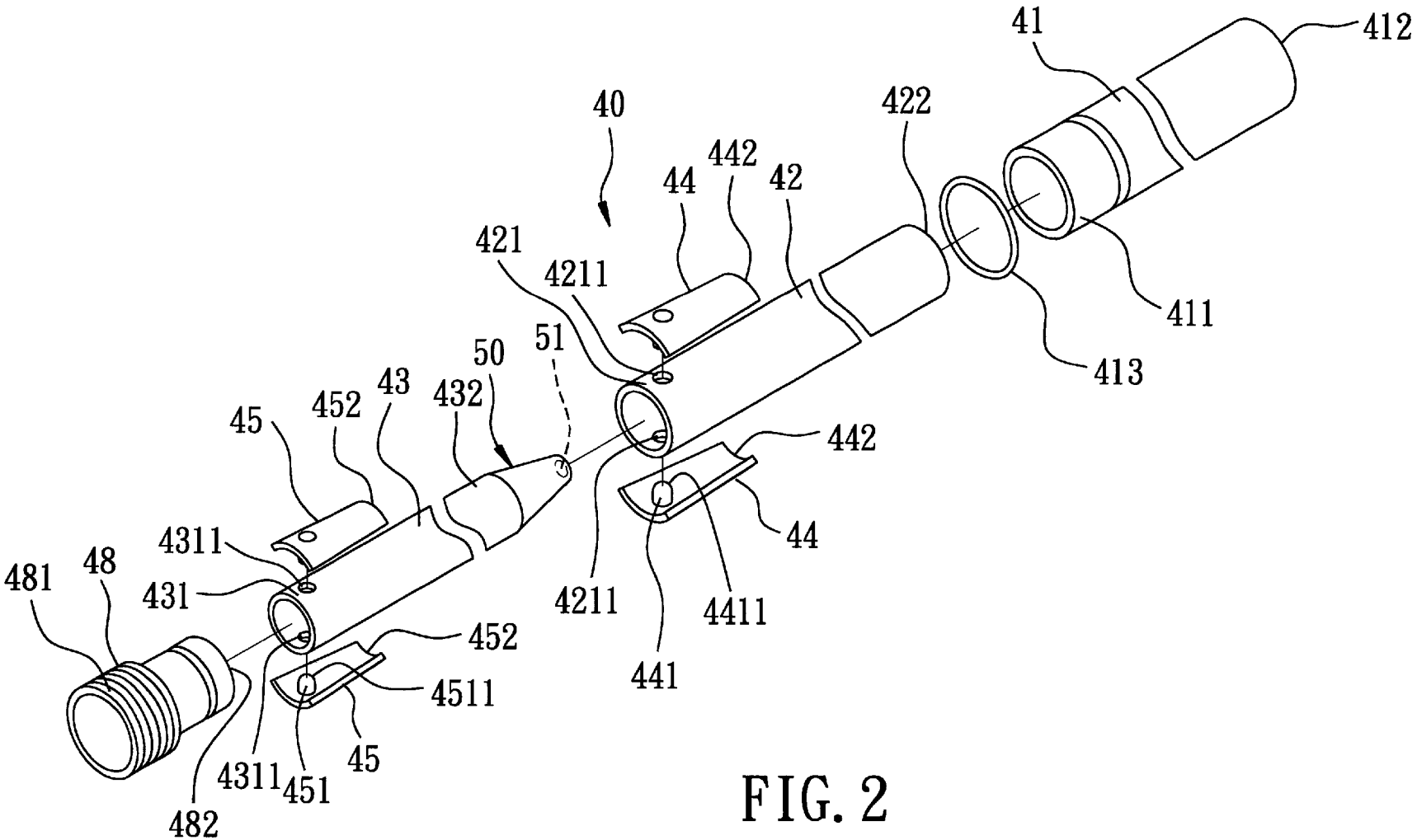
FIG. 2 is an exploded perspective view of a first preferred embodiment of a spray tube of an air spray device according to this invention.
Figure 3:
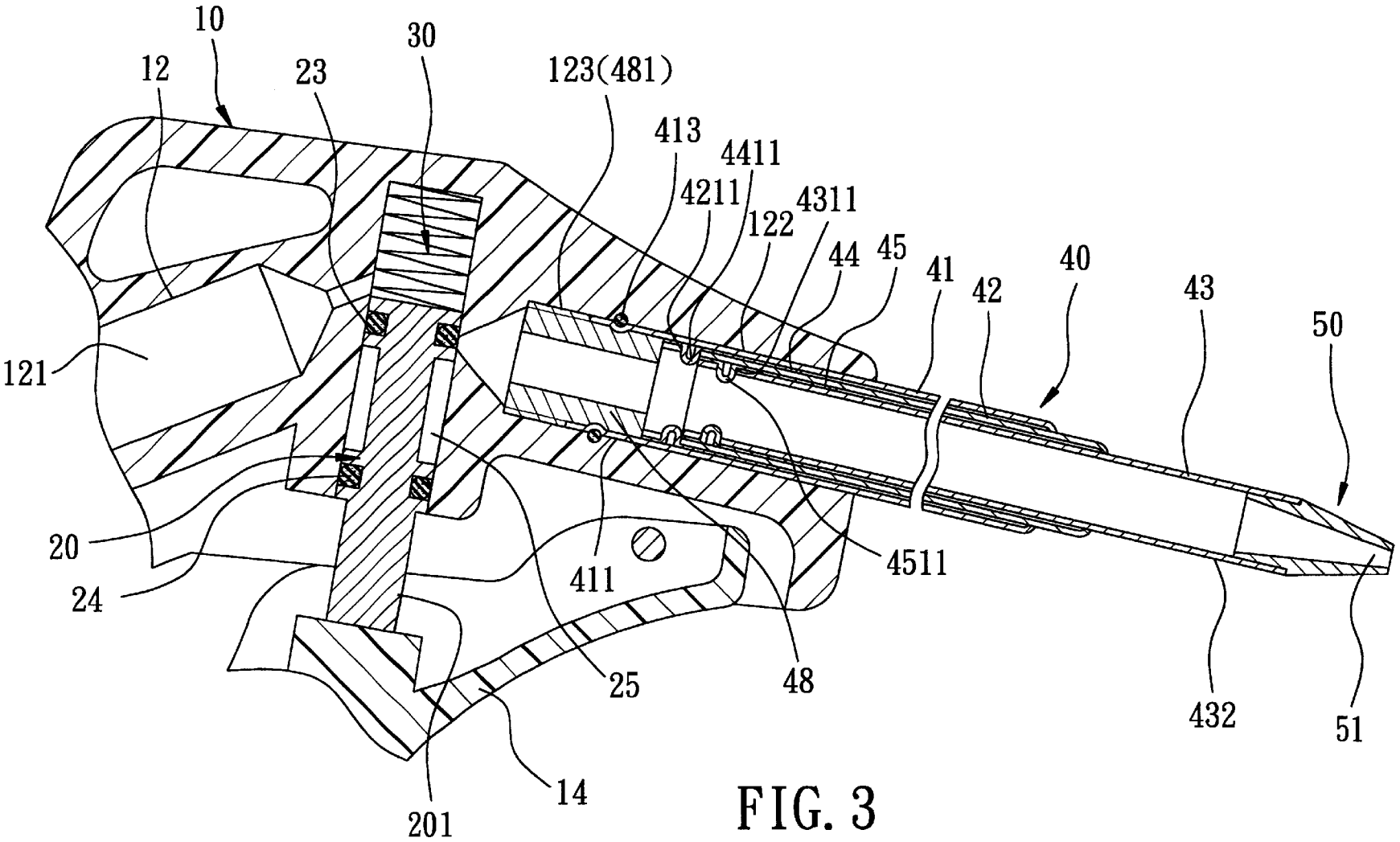
FIG. 3 is a sectional view of the first preferred embodiment in a retracted state.
Figure 4:
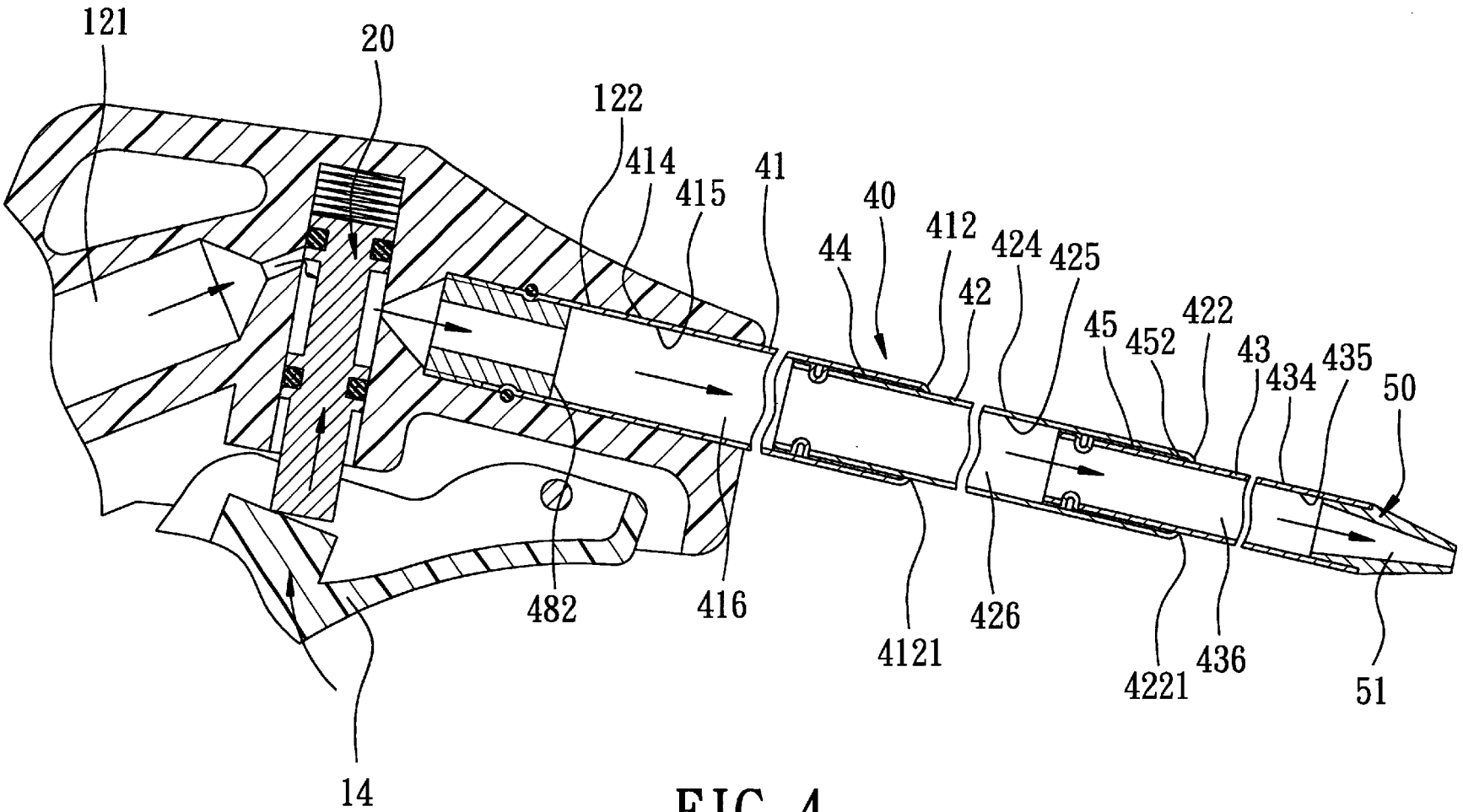
FIG. 4 is a sectional view of the first preferred embodiment in a stretched state.

Referring to FIGS. 2, 3 and 4, the first preferred embodiment of the air spray device according to the present invention is shown to comprise a barrel 10, a biasing member 30, an actuator 14, a spray tube 40, a nozzle portion 50, and a plurality of retaining members.

The barrel 10 has an inner surrounding wall to define a passage 12 which has an inlet 121 and an outlet 122 downstream of the inlet 121, and a controlling member which includes a valve body 20 disposed in the passage 12 between the inlet 121 and the outlet 122, and a stem portion 201 which has an inner end that engages the valve body 20 and an outer end that extends from the inner end and transversely and outwardly of the inner surrounding wall so as to be actuated to move the valve body 20 to have an annular groove 25 aligned with the inlet 121 and the outlet 122 to establish fluid communication between the inlet 121 and the outlet 122.

The biasing member 30 is disposed to bias the valve body 20 to interrupt the fluid communication between the inlet 121 and the outlet 122 via upper and lower O-rings 23, 24 which are sleeved on the valve body 20 and which are disposed at opposite sides of the annular groove 25.

The actuator 14 is disposed pivotally on the barrel 10 to actuate the outer end of the stem portion 201 to move the valve body 20 against a biasing action of the biasing member 30.

In this embodiment, the spray tube 40 includes first, second and third tube portions 41, 42, 43.

The first tube portion 41 has a first proximate end 411, a bushing 48 which is inserted into the first proximate end 411 and which has an externally threaded portion 481 that engages threadedly an internally threaded portion 123 of the outlet 122 and that is in fluid communication with the outlet 122, an O-ring 413 which is sleeved on the first proximate end 411 to provide an air-tight connection, a first distal end 412 which is disposed opposite to the first proximate end 411 in a longitudinal direction and downstream of the first proximate end 411, and a first intermediate tubular portion which is interposed between the first proximate and distal ends 411, 412. The first intermediate tubular portion includes a first outer tubular wall surface 414, and a first inner tubular wall surface 415 which defines a first conduit 416 opposite to the first outer tubular wall surface 415 radially and which is disposed between and which communicates with the first proximate and distal ends 411, 412.

The second tube portion 42 has a second proximate end 421 which is inserted into the first conduit 416, a second distal end 422 which is disposed opposite to the second proximate end 421 in the longitudinal direction and downstream of the second proximate end 421 and which extends outwardly of the first distal end 412, and a second intermediate tubular portion which is interposed between the second proximate and distal ends 421, 422. The second intermediate tubular portion includes a second outer tubular wall surface 424 of a diameter which is smaller than that of the first inner tubular wall surface 415 so as to be telescopically fitted in the first conduit 416 in the longitudinal direction and to be slidable between a stretched position (as shown in FIG. 4), where the second proximate end 421 is close to the first distal end 412, and a retracted position (as shown in FIG. 3), where the second proximate end 421 is close to the first proximate end 411, and a second inner tubular wall surface 425 which is disposed opposite to the second outer tubular wall surface 424 radially and which defines a second conduit 426 that is in fluid communication with the first conduit 416.

The third tube portion 43 has a third proximate end 431 which is inserted into the second conduit 426, a third distal end 432 which is disposed opposite to the third proximate end 431 in the longitudinal direction and downstream of the third proximate end 431 and which extends outwardly of the second distal end 422, and a third intermediate tubular portion which is interposed between the third proximate and distal ends 431, 432. The third intermediate tubular portion includes a third outer tubular wall surface 434 of a diameter which is smaller than that of the second inner tubular wall surface 425 so as to be telescopically fitted in the second conduit 426 in the longitudinal direction, and a third inner tubular wall surface 435 which is disposed opposite to the third outer tubular wall surface 434 radially and which defines a third conduit 436 that is in fluid communication with the second conduit 426.

In addition, each of the first and second distal ends 412, 422 has a ring portion 4121, 4221 which extends radially and inwardly therefrom to frictionally and slidably contact a respective one of the second and third outer tubular wall surfaces 424, 434 so as to confine a respective one of clearances between the first inner and the second outer tubular wall surfaces 415, 424, and between the second inner and the third outer tubular wall surfaces 425, 434. Each of the second and third inner tubular wall surfaces 425, 435 defines a pair of insert holes 4211, 4311 to communicate with a respective one of the second and third outer tubular wall surfaces 424, 434.

The nozzle portion 50 is disposed on the third distal end 432 and distal to the third proximate end 431, and is fluidly communicated with the third conduit 436.

The retaining members includes a first retaining member 482 which is an abutment wall of the bushing 48 in this embodiment, and which extends radially and inwardly from the first inner tubular wall surface 415 proximate to the first proximate end 411 so as to arrest further movement of the second proximate end 421 toward the first proximate end 411 in the retracted position. A second retaining member and a fourth retaining member are disposed between the first distal end 412 and the second outer tubular wall surface 424 proximate to the second proximate end 421, and between the second distal end 422 and the third outer tubular wall surface 434 proximate to the third proximate end 431, respectively. Each of the second and fourth retaining members includes abutment portions 442, 452 of a pair of retaining plates 44, 45 which are disposed on and which extend outwardly and radially from the respective one of the second and third outer tubular wall surfaces 424, 434 such that the abutment portions 442, 452 are accommodated in the respective clearance and are movable relative to the respective one of the first and second inner tubular wall surfaces 415, 425 so as to abut against the respective ring portion 4121, 4221 in the stretched position, thereby arresting further movement of the second and third proximate ends 421, 431 toward the first and second distal ends 412, 422, respectively. Each retaining plate 44, 45 is detachably sleeved on the respective one of the second and third outer tubular wall surfaces 424, 425, and further has a connecting end opposite to the abutment portion 442, 452 in the longitudinal direction and proximate to the respective one of the second and third proximate ends 421, 431. An insert member 441, 451 is formed integrally on the retaining plate 44, 45 proximate to the connecting end, and is received in the insert hole 4211, 4311. A third retaining member 4411, 4511 is connected integrally to the insert member 441, 451, and extends radially and inwardly of the respective one of the second and third inner tubular wall surfaces 425, 435 so as to arrest further movement of the third proximate end 431 toward the second proximate end 421 in the retracted position.

In use, the third tube portion 43 is pulled outwardly to abut the abutment portions 452 against the ring portion 4221 so as to permit the second tube portion 42 to be pulled outwardly until the abutment portions 442 abut against the ring portion 4121 to place the spray tube 40 in the stretched position, as shown in FIG. 4. Thus, the distance between the barrel 10 and an opening 51 of the nozzle portion 50 is lengthened so as to prevent dust on an object from flying over the user during cleaning of the object.

When it is desired to retract the spray tube 40 for storing the air spray device, the nozzle portion 50 is forced to move the third tube portion 43 into the second conduit 426 so as to abut the third proximate end 431 against the third retaining member 441 such that the second tube portion 42 is moved inwardly of the first conduit 416 until the second proximate end 421 abuts against the first retaining member 482.

Figure 5:
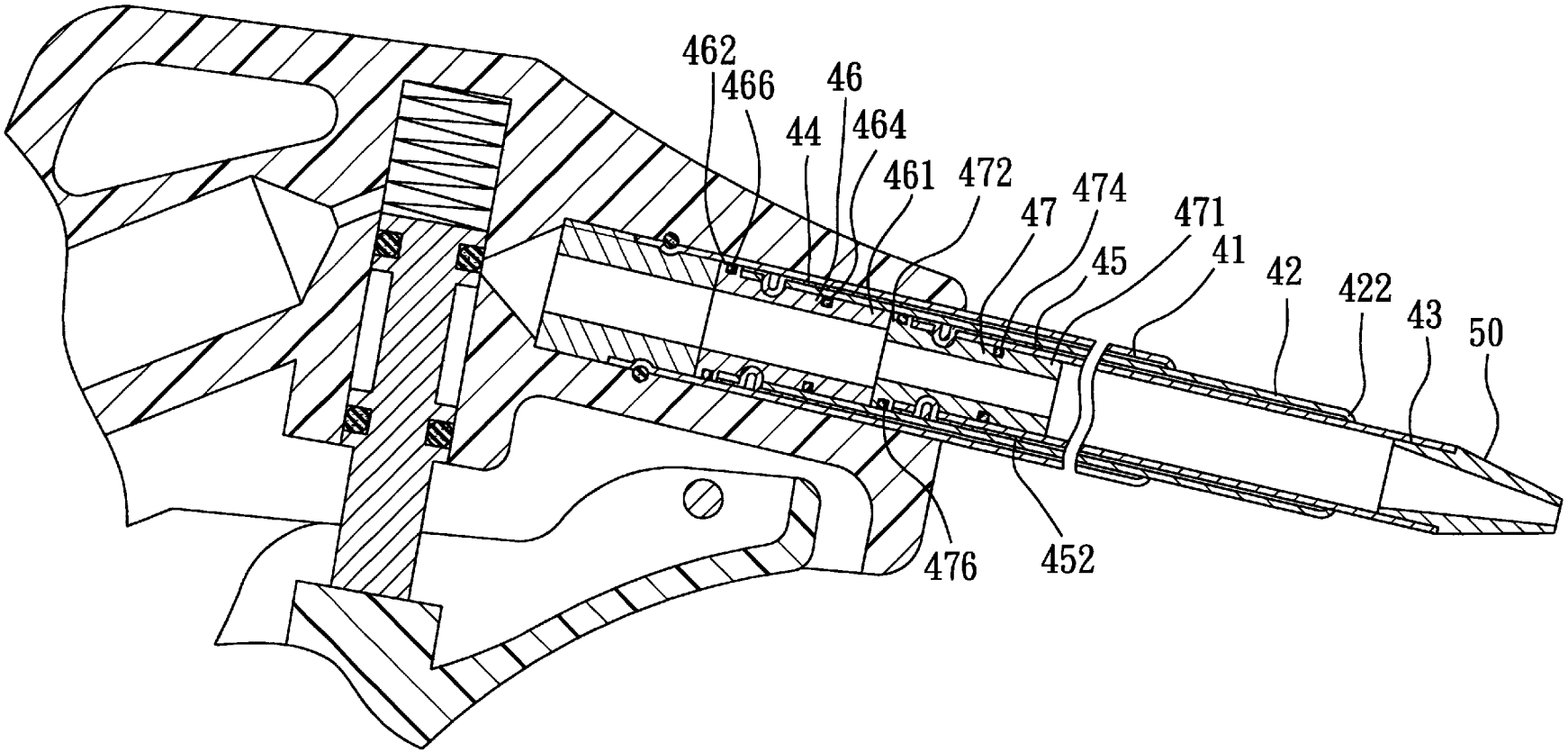
FIG. 5 is a sectional view of a second preferred embodiment of this invention in a retracted state.
Figure 6:
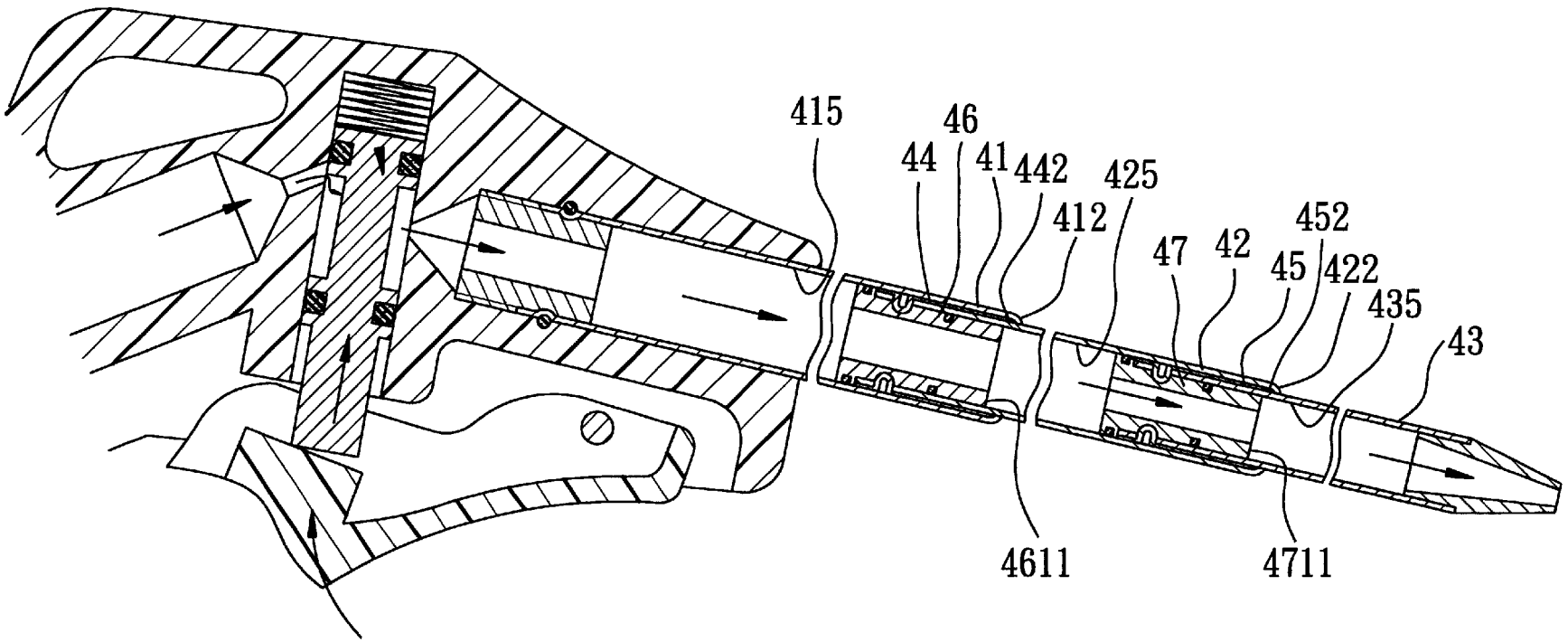
FIG. 6 is a sectional view of the second preferred embodiment in a stretched state.

As shown in FIGS. 5 and 6, the second preferred embodiment of the air spray device according to this invention is shown to be substantially similar to the first preferred embodiment in construction. Additionally, two bushings 46, 47 are disposed respectively on the second and third tube portions 42, 43. Each bushing 46, 47 includes an inner portion 461, 471 which is disposed on a respective one of the second and third inner tubular wall surfaces 425, 435 proximate to the second and third proximate ends 421, 431, and which has an abutment wall 4611, 4711 to serve as the third retaining members, and an annular end 462, 472 which extends outwardly and radially of and beyond the respective one of the second and third proximate ends 421, 431 so as to frictionally and slidably contact a respective one of the first and second inner tubular wall surfaces 415, 425. A plurality of O-rings 466, 464, 476, 474 are disposed between the annular ends 462, 472 and the first and second inner tubular wall surfaces 415, 425, and between the inner portion 461, 471 and the second and third inner tubular wall surfaces 425, 435 so as to provide air-tight connection therebetween.

Figure 7:
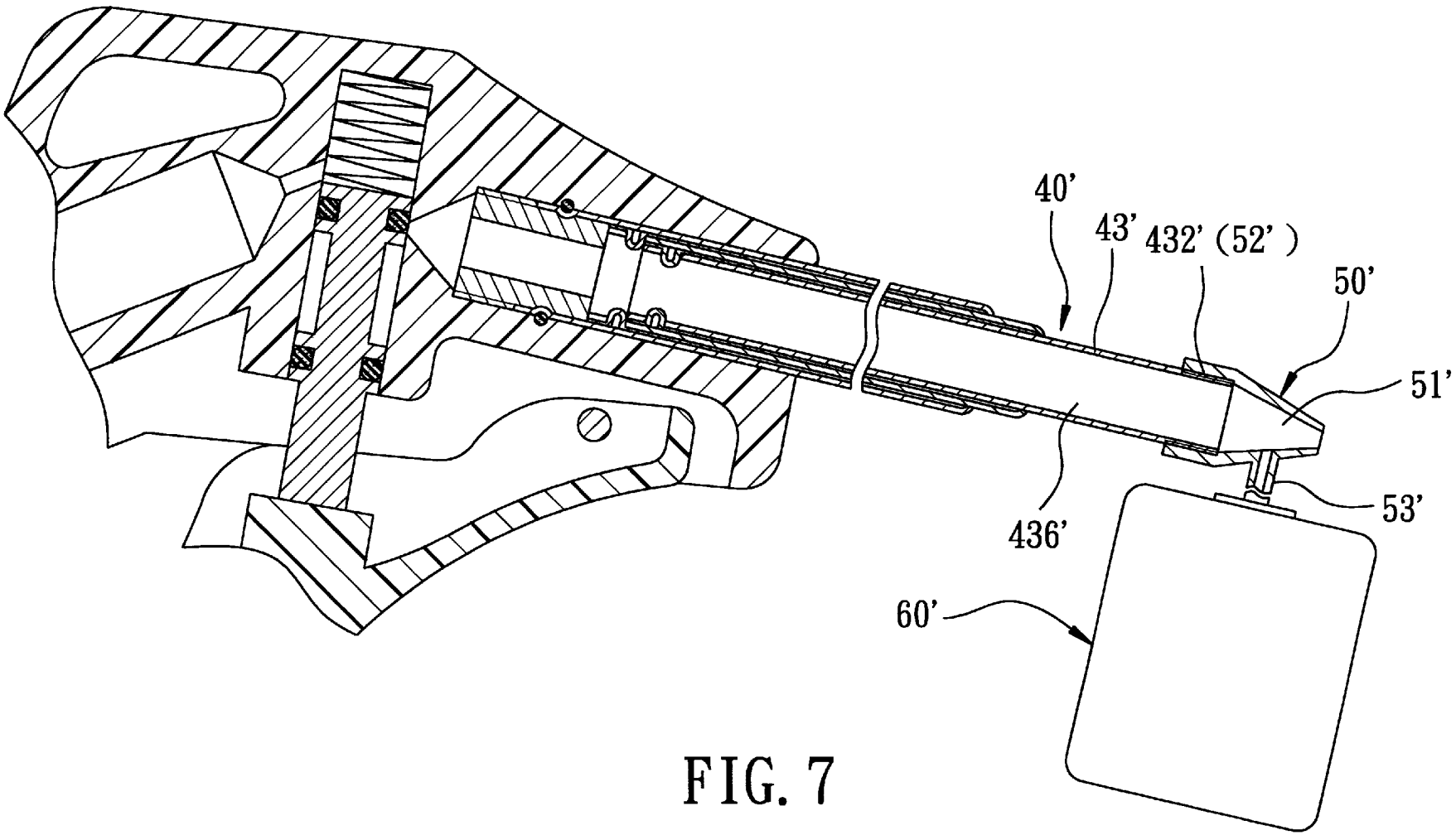
FIG. 7 is a sectional view of a third preferred embodiment of this invention in a retracted state.

As shown in FIG. 7, the third preferred embodiment of the air spray device according to this invention is also shown to be substantially similar to the first preferred embodiment in construction. The nozzle portion 50' has an internally threaded portion 52' which engages threadedly and detachably an externally threaded portion of the third distal end 432' of the third tube portion 43' of the spray tube 40'. The nozzle portion 50' has an opening 51' downstream of the third conduit 436', and an intake port 53' which is disposed between and which is in fluid communication with the third conduit 436' and the opening 51'. Thus, the intake port 53', is adapted to be in fluid communication with a liquid container 60', such as a painting container, to cause the liquid contained therein to be entrained in an air stream which flows from the third conduit 436' and out of the opening 51'.

After use, the nozzle portion 50' can be detached from the spray tube 40' for convenient cleaning. In addition, the nozzle portion 50' can be changed for operating with different colors of paint.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An air spray device comprising:

a barrel having an inner surrounding wall to define a passage having an inlet and an outlet downstream of said inlet, and a controlling member including a valve body disposed in said passage between said inlet and said outlet, and a stem portion having an inner end engaging said valve body and an outer end extending from said inner end and transversely and outwardly of said inner surrounding wall so as to be actuated to move said valve body to permit fluid communication between said inlet and said outlet;

a biasing member disposed to bias said valve body to interrupt the fluid communication between said inlet and said outlet;

an actuator disposed on said barrel to actuate said outer end of said stem portion to move said valve body against a biasing action of said biasing member;

a spray tube including a first tube portion having a first proximate end which is connected to and which is in fluid communication with said outlet, a first distal end opposite to said first proximate end in a longitudinal direction and downstream of said first proximate end, and a first intermediate tubular portion interposed between said first proximate and distal ends, said first intermediate tubular portion including a first outer tubular wall surface, and a first inner tubular wall surface which defines a first conduit opposite to said first outer tubular wall surface radially and disposed between and communicating with said first proximate and distal ends, and a second tube portion having a second proximate end which is inserted into said first conduit, a second distal end which is disposed opposite to said second proximate end in the longitudinal direction and downstream of said second proximate end and which extends outwardly of said first distal end, and a second intermediate tubular portion which is interposed between said second proximate and distal ends, said second intermediate tubular portion including a second outer tubular wall surface of a diameter which is smaller than that of said first inner tubular wall surface so as to be telescopically fitted in said first conduit in the longitudinal direction and to be slidable between a stretched position, where said second proximate end is close to said first distal end, and a retracted position, where said second proximate end is close to said first proximate end, and a second inner tubular wall surface opposite to said second outer tubular wall surface radially and defining a second conduit that is in fluid communication with said first conduit;

a first retaining member disposed on and extending radially and inwardly from said first inner tubular wall surface proximate to said first proximate end so as to arrest further movement of said second proximate end toward said first proximate end in the retracted position; and a second retaining member disposed between said first distal end and said second outer tubular wall surface proximate to said second proximate end to arrest further movement of said second proximate end toward said first distal end in the stretched position.

2. The air spray device of claim 1, wherein said spray tube further includes a third tube portion having a third proximate end inserted into said second conduit, a third distal end disposed opposite to said third proximate end in the longitudinal direction and downstream of said third proximate end, and extending outwardly of said second distal end, and a third intermediate tubular portion interposed between said third proximate and distal ends, and including a third outer tubular wall surface of a diameter which is smaller than that of said second inner tubular wall surface so as to be telescopically fitted in said second conduit in the longitudinal direction, and a third inner tubular wall surface which is disposed opposite to said third outer tubular wall surface radially and which defines a third conduit that is in fluid communication with said second conduit;

said air spray device further comprising:

a third retaining member disposed on and extending radially and inwardly from said second inner tubular wall surface proximate to said second proximate end so as to arrest further movement of said third proximate end toward said second proximate end in the retracted position, and a fourth retaining member disposed between said second distal end and said third outer tubular wall surface proximate to said third proximate end to arrest further movement of said third proximate end toward said second distal end in the stretched position.

3. The air spray device of claim 2, wherein each of said second and fourth retaining members includes a ring portion disposed on and extending radially and inwardly from a respective one of said first and second distal ends to frictionally and slidably contact a respective one of said second and third outer tubular wall surfaces so as to confine a respective one of clearances between said first inner and said second outer tubular wall surfaces, and between said second inner and said third outer tubular wall surfaces, and an abutment portion disposed on and extending outwardly and radially from the respective one of said second and third outer tubular wall surfaces proximate to a respective one of said second and third proximate ends such that said abutment portion is accommodated in said clearance and is movable relative to the respective one of said first and second inner tubular wall surfaces so as to abut against said ring portion in the stretched position.

4. The air spray device of claim 3, wherein said abutment portion extends in a longitudinal direction toward a respective one of said second and third proximate ends and terminates at a connecting end, said second inner tubular wall surface defining an insert hole to communicate with said second outer tubular wall surface, said air spray device further comprising an insert member received in said insert hole and extending radially to interconnect said third retaining member and said connecting end.

5. The air spray device of claim 4, wherein said abutment portion, said connecting end, said insert member and said third retaining member are formed into a single piece construction which is detachably connected to said second intermediate tubular portion.

6. The air spray device of claim 5, wherein said third retaining member extends along said second inner tubular wall surface in a longitudinal direction towards and beyond said second proximate end to form an annular end which extends outwardly and radially so as to frictionally and slidably contact said first inner tubular wall surface, said air spray device further including an O-ring disposed between said annular end and said first inner tubular wall surface so as to provide air-tight connection therebetween.

7. The air spray device of claim 2, further comprising a nozzle portion disposed on said third distal end and distal to said third proximate end, and fluidly communicated with said third conduit.

8. The air spray device of claim 7, wherein said nozzle portion is detachably disposed on said third distal end.

9. The air spray device of claim 8, wherein said nozzle portion has an opening downstream of said third conduit, and an intake port disposed between said third conduit and said opening, and in fluid communication with said opening and said third conduit, said intake port being adapted to be in fluid communication with a liquid container so as to cause the liquid contained therein to be entrained in an air stream which flows from said third conduit and out of said opening.

* * * * *